US009453354B1

(12) United States Patent
Goettl

(10) Patent No.: US 9,453,354 B1
(45) Date of Patent: Sep. 27, 2016

(54) METHOD AND APPARATUS TO PREVENT EXCESSIVE SUCTION IN VENTURI-TYPE SWIMMING POOL SKIMMERS

(71) Applicant: GSG Holdings, Inc., Chandler, AZ (US)

(72) Inventor: John M. Goettl, Phoenix, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 100 days.

(21) Appl. No.: 14/496,142

(22) Filed: Sep. 25, 2014

Related U.S. Application Data

(60) Provisional application No. 61/882,533, filed on Sep. 25, 2013.

(51) Int. Cl.
*E04H 4/16* (2006.01)

(52) U.S. Cl.
CPC ..... *E04H 4/16* (2013.01)

(58) Field of Classification Search
CPC ..... E04H 4/16
USPC ..... 210/167.1, 167.12, 167.19, 416.1, 210/416.2
See application file for complete search history.

(56) References Cited

U.S. PATENT DOCUMENTS

| | | | | |
|---|---|---|---|---|
| 4,154,679 | A * | 5/1979 | Farage | E04H 4/1272 210/121 |
| 5,830,350 | A | 11/1998 | Voss et al. | |
| 6,022,481 | A | 2/2000 | Blake | |
| 7,300,576 | B1 | 11/2007 | Blake | |
| 7,563,365 | B2 | 7/2009 | Pellington et al. | |

* cited by examiner

*Primary Examiner* — Fred Prince
(74) *Attorney, Agent, or Firm* — Booth Udall Fuller, PLC

(57) ABSTRACT

A pool skimmer system including a skimmer housing and basket is disclosed. The skimmer housing includes a skimmer rim, a deck throat opening and a pool throat opening, a pump inlet port, a pool return port positioned at a first portion of a housing bottom, and one or more pump suction ports positioned at a second portion of the housing bottom. The basket is positioned within the housing and includes a basket rim engaged with the skimmer rim, one or more porous walls, and a seal plate extending from a basket bottom to the housing bottom. The seal plate is positioned between the first portion of the housing bottom and the second portion of the housing bottom to form a suction chamber. The suction chamber is adjacent the one or more pump suction ports and isolated from the pump inlet port and the pool return port.

20 Claims, 5 Drawing Sheets

METHOD AND APPARATUS TO PREVENT EXCESSIVE SUCTION IN VENTURI-TYPE SWIMMING POOL SKIMMERS

CROSS REFERENCE TO RELATED APPLICATIONS

This document claims the benefit of the filing date of U.S. Provisional Patent Application 61/882,533, entitled "Method and Apparatus to Prevent Excessive Suction in Venturi-Type Swimming Pool Skimmers" to Goettl which was filed on Sep. 25, 2013, the contents of which are hereby incorporated by reference.

BACKGROUND

1. Technical Field

Aspects of this document relate generally to pool skimmer systems.

2. Background Art

Most swimming pools have a skimming device connected to the suction of a pump to draw water from the pool at or very near the pool surface. These devices usually include a basket or strainer to separate larger debris such as leaves and other floating particles. Water drawn from the skimmer can be connected to the suction of a pump that is connected to a typical swimming pool filter system and returned back to the pool in one or more ordinary ways well known in the art. It is common to connect the suction of several pumps to a skimmer in order to enhance skimming action. There are skimmers, commonly called venturi skimmers, equipped with a pressure jet located to entrain water within the skimmer and eject it back to the pool through a relatively short, unobstructed conduit. This method produces a significant flow increase through the skimmer, resulting in improved surface debris entrapment.

Typically, the pump suction connected to a skimmer is also connected to one or more other drains within the pool. This provides protection to the skimmer basket should it become blocked by debris. The suction is simply diverted to the other drain thereby protecting the skimmer basket from deformation or bursting.

In the case of a venturi skimmer, when the debris basket becomes blocked the venturi return line becomes a point of suction that can be very dangerous to a bather. When the suction of a pump is connected to a Venturi-type skimmer, the flow through the venturi return is reversed when the basket becomes full due to the suction of the separately attached pump.

There are skimming devices that provide air relief in an effort to solve the forgoing problems. U.S. Pat. No. 5,830,350 to Price describes a skimmer basket that has a central perforated pylon extending from the basket bottom to above the basket rim. The pylon consumes a portion of the basket capacity and is difficult to manufacture. U.S. Pat. No. 7,300,576 to Blake describes a conventional Venturi skimmer with an external tube running from the upper interior of the main skimmer body to a location below the skimmer basket in the main skimmer body. This method results in a necessarily small tube on the exterior of the skimmer. This small tube is costly to manufacture and very difficult to clean due to the 90 degree turns associated with the small tube. Furthermore, the chance of damaging the skimmer during the construction process is also increased due to its exterior nature.

SUMMARY

According to one aspect, a pool skimmer comprises a skimmer housing and a basket. The skimmer housing comprises an upper housing, a lower housing, and a skimmer rim positioned within the housing. The upper housing comprises a deck throat opening and a pool throat opening. The lower housing comprises a pump inlet port and a pool return port positioned adjacent a first portion of a housing bottom of the lower housing and one or more pump suction ports positioned adjacent a second portion of the housing bottom of the lower housing. The basket is positioned within the housing and comprises a basket rim engaged with the skimmer rim, one or more porous walls, and a seal plate extending from a basket bottom to the housing bottom. The seal plate is positioned between the first portion of the housing bottom and the second portion of the housing bottom to form a suction chamber that is adjacent the one or more pump suction ports and isolated from the pump inlet port and the pool return port.

Various implementations and embodiments may comprise one or more of the following. The seal plate may extend across a diameter of the basket bottom and further comprises two opposing seal arms that extend from the basket bottom towards the basket rim on an outer surface of the basket. The two seal arms may extend from the basket bottom to the basket rim. The basket may further comprise a basket divider positioned within the basket and aligned with the seal plate and the two seal arms. The housing may further comprise two sets of tracks near the housing bottom and positioned between the first portion of the housing bottom and the second portion of the housing bottom. The seal plate may be slidably engaged with the two sets of tracks. A venturi nozzle coupled to the pump inlet port and a venturi sleeve coupled to the pool return port, and wherein the one or more pump suction ports comprises two pump suction ports positioned adjacent a second portion of the housing bottom. A fluid path between the one or more porous walls of the basket and the housing. The seal plate may extend at least one inch from the basket bottom.

According to another aspect, a pool skimmer system comprises a skimmer housing and a basket. The skimmer housing comprises an upper housing, a lower housing, and a skimmer rim. The upper housing comprises a deck throat opening and a pool throat opening and the lower housing comprising a pump inlet port and a pool return port positioned adjacent a first portion of a housing bottom of the lower housing and one or more pump suction ports positioned adjacent a second portion of the housing bottom of the lower housing. The basket is sized to removably mount within the skimmer housing and comprising a basket rim configured to engage with the skimmer rim when the basket is mounted within the skimmer housing, one or more porous walls, and a seal plate extending from a basket bottom and sized to interface with the basket bottom when the basket rim is engaged with the skimmer rim such that the seal plate is positioned between the first portion of the housing bottom and the second portion of the housing bottom to form a suction chamber that is adjacent the one or more pump suction ports and isolated from the pump inlet port and the pool return port between the basket bottom and the housing bottom by the seal plate when the basket is mounted within the skimmer housing and the skimmer rim is engaged with the basket rim.

Various implementations and embodiments may comprise one or more of the following. The seal plate may further comprise two opposing seal arms that extend from the basket bottom towards the basket rim on an outer surface of the basket. The two seal arms may extend from the basket bottom to the basket rim. The basket may further comprise a basket divider positioned within the basket and aligned with the seal plate and the two seal arms. The housing may further comprise two sets of tracks near the housing bottom and positioned between the first portion of the housing bottom and the second portion of the housing bottom and wherein the seal plate is configured to slidably engage with the two sets of tracks. The pool skimmer may further comprise a venturi nozzle coupled to the pump inlet port and a venturi sleeve coupled to the pool return port, and the one or more pump suction ports may comprise two pump suction ports positioned adjacent a second portion of the housing bottom. The seal plate may extend at least one inch from the basket bottom.

According to another aspect, a pool skimmer basket comprises one or more porous sidewalls, a basket rim, a porous basket bottom opposite the basket rim, and a seal plate extending at least one inch from the porous basket bottom. The seal plate is configured to isolate a first portion of a skimmer housing bottom from a second portion of a skimmer housing bottom when the pool skimmer basket is mounted within a pool skimmer housing.

Various implementations and embodiments of a pool skimmer basket may including one or more of the following. Two opposing seal arms that extend from the basket bottom towards the basket rim on an outer surface of the basket. The two seal arms may extend from the basket bottom to the basket rim. A basket divider positioned within the basket and aligned with the seal plate and the two seal arms. The seal plate may extend at least 2 inches from the porous basket bottom.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended pool skimmer systems and/or assembly procedures for pool skimmer systems will become apparent for use with implementations of pool skimmer systems from this disclosure. Accordingly, for example, although particular pool skimmer systems are disclosed, such pool skimmer systems and implementing components may comprise any shape, size, style, type, model, version, measurement, concentration, material, quantity, and/or the like as is known in the art for such pool skimmer systems and implementing components, consistent with the intended operation of pool skimmer systems.

Figure 1:
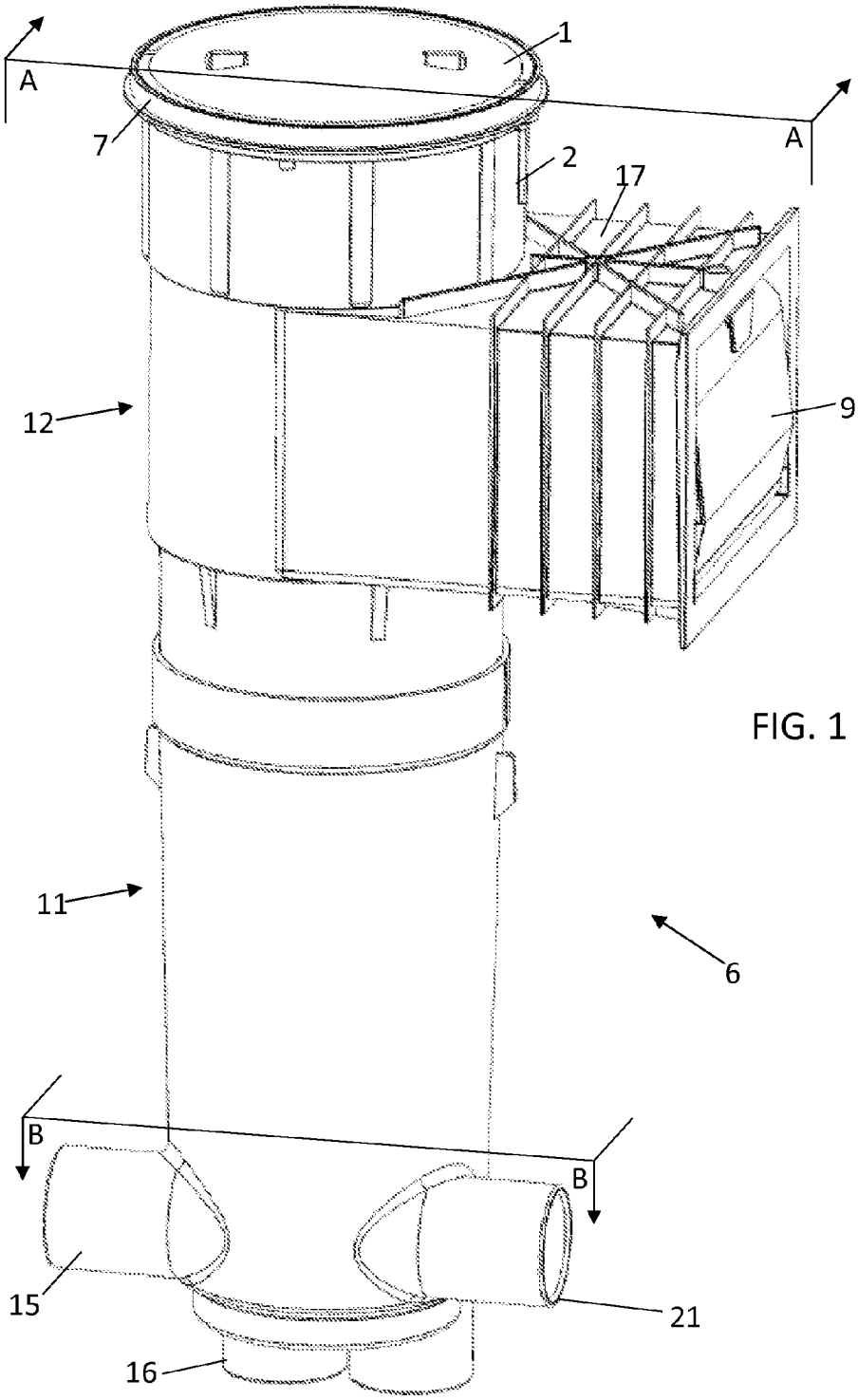
FIG. 1 is a perspective view of a pool skimmer housing.

FIG. 1 depicts a non-limiting embodiment of a pool skimmer housing. Reference is made throughout this document to an upper skimmer housing 12 and a lower skimmer housing 11. It is contemplated that the upper skimmer housing 12 and the lower skimmer housing 11 may comprise two separate and individual pieces coupled together, or a single piece integrally formed during manufacture. In the non-limiting embodiment depicted in FIG. 1, the upper skimmer housing 12 and the lower skimmer housing 11 comprise two separate pieces coupled together. It is further contemplated embodiments of a pool skimmer system 6 in general and a pool skimmer housing referenced in this document may comprise various features of a pool skimmer housing previously known in the art, such as but not limited to a pool throat opening 3 having an upper wall 17 and a lower wall 18 (shown in FIG. 2), a weir 9 hingedly or otherwise pivotally coupled to the upper skimmer housing 12 proximate a pool throat opening 3, a deck closure or cover 1 coupled to the upper skimmer housing 12 proximate a deck throat opening 5, one or more pump suction ports 16 on a bottom 20 of the lower skimmer housing 11, a finish edge 7, a skimmer interior wall 4, a deck ring 2, and the like. In one or more embodiments, the pool surface elevation is approximately one-half of the pool throat opening 3, or halfway between the upper wall 17 and the lower wall 18 of the pool throat opening 3. However, the pool elevation can vary from upper elevation at the upper wall 17 to a lower elevation at the lower wall 18 due to increased bather influx, rain, insufficient make up water, and other reasons known in the art. Some skimmer embodiments are adapted with an overflow port to limit and provide an attachment point of piping to carry away overflow to a suitable area away from the pool. Normally, the maximum water containing height of a pool is approximately upper elevation at the upper wall 17.

The skimmer housing typically further comprises a basket opening positioned within the pool skimmer housing and sized to house a basket 10. To facilitate housing of the basket 10 within the skimmer housing, the upper skimmer housing 12 comprises a first basket opening 61 and the lower skimmer housing 11 comprises a second basket opening 62 aligned with the first basket opening 61.

Additionally, the lower skimmer housing 11 may comprise a venturi system 36. The venturi system typically comprises a pump inlet port 15 having a venturi nozzle 13 coupled thereto and a pool return port 21 having a venturi sleeve 14 coupled thereto. The pump inlet port 15 and/or the pool return port 21 may extend through the bottom 20 of the lower skimmer housing 11 or through a sidewall of the lower skimmer housing 11 near the bottom 20 of the lower skimmer housing 11. The venturi system 36 may operate as is known to those having ordinary skill in the art. For example, a pool pump associated with the system may pull water in the skimmer housing into the one or more pump suction ports 16 or any other suction ports known in the art, push water into the skimmer housing through the pump inlet port 15, and push water into the pool return port 21 to return filtered water back into the pool and create a high velocity flow to entrain water in the skimmer housing, thereby creating an increased flow through the skimmer. The one or more conventional pump suction ports 16 are configured for connection of additional pump or pump suction and drain connection in the conventional manner.

Figure 3:
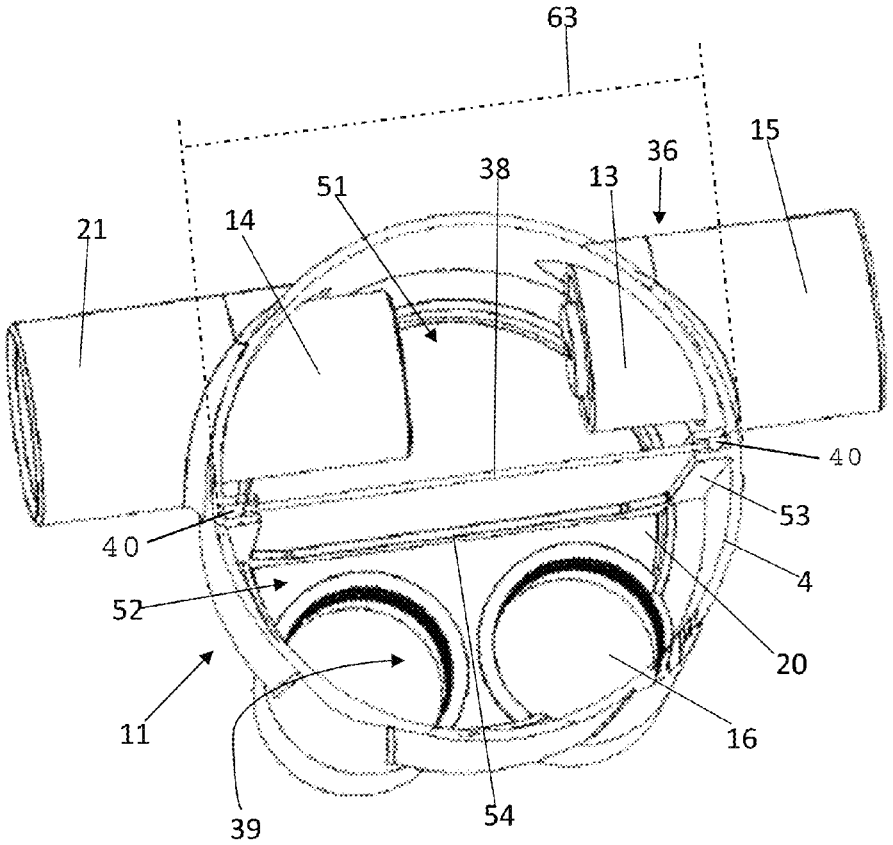
FIG. 3 is a cross sectional view taken along sectional line B-B in FIG. 1.

In particular embodiments, the pump inlet port 15 and the pool return port 21 are positioned adjacent a first portion 51 of a housing bottom 20, while the one or more pump suction ports 16 are positioned adjacent a second portion 52 of the housing bottom 20 of the lower housing 11 (shown in FIG. 3). More particularly and as depicted throughout the figures, in some non-limiting embodiments, the one or more pump suction ports 16 extend through the housing bottom 20 on a second side or second portion 52 of the housing bottom. The pump inlet port 15 and the pool return port 21 typically extend through the skimmer interior wall 4 proximate a first side or first portion 51 of the housing bottom 20. The first portion 51 and second portion 52 of the housing bottom 20 may be substantially equal in area, as depicted in the non-limiting embodiment of FIG. 3. Alternatively, the first portion 51 and second portion 52 of the housing bottom 20 may be adapted to differing sizes to meet the specific needs of the pump suction ports 16, the pump inlet port 15, and the pool return port 21.

In one or more embodiments, the pool skimmer system 6 further comprises one or more sets of tracks. The sets of tracks are configured to engage with and guide the seal plate 38 and/or seal arms 55 of the basket 10 to divide the first portion 51 of the housing bottom 20 from the second portion 52. Typically, the seal plate 38 and/or seal arms 55 of the basket 10 slide between the set of tracks to guide the basket 10 into proper position and/or create a more effective seal between the first portion 51 and the second portion 52 of the housing bottom 20. According to some aspects, the pool skimmer system 6 comprises opposing sets of side tracks 53 that extend from or adjacent to the housing bottom 20 toward the skimmer rim 28. In some embodiments, the sets of side tracks 53 extend all the from the housing bottom 20 to the skimmer rim 28. In other embodiments, the side tracks 53 extend only partially between the housing bottom 20 and the skimmer rim 28. In or more embodiments, the pool skimmer system 6 comprises a set of bottom tracks 54 in addition or as an alternative to the side tracks 53. The set of bottom tracks 54 are typically positioned on the housing bottom 20 and divide the first portion 51 of the housing bottom 20 from the second portion 52. In some embodiments, the bottom tracks 54 are continuous with the side tracks 53.

In one or more embodiments, the skimmer housing comprises a skimmer rim 28. The skimmer rim 28 is configured to engage with the basket rim 25 of the basket 10 and support the basket 10 in an operating position when the basket 10 is mounted in the skimmer housing. The skimmer rim 28 is typically positioned adjacent to the first basket opening 62. More particularly, the skimmer rim 28 may be positioned at an elevation that is similar to or lower than the lower wall 18 of the pool throat opening 3. In the non-limiting embodiment depicted in FIG. 2, the skimmer rim 28 is positioned just below the lower wall 18 of the pool throat opening 3. In other embodiments, the skimmer rim 28 is positioned below the elevation or level of the lower wall 18 of the pool throat opening 3. According to some aspects, the skimmer rim 28 extends around the entire circumference of the first basket opening 61 of the upper skimmer housing 12. In other embodiments, the skimmer rim 28 extends only partially around the circumferences of the first basket opening 61 of the upper skimmer housing 12.

Figure 2:
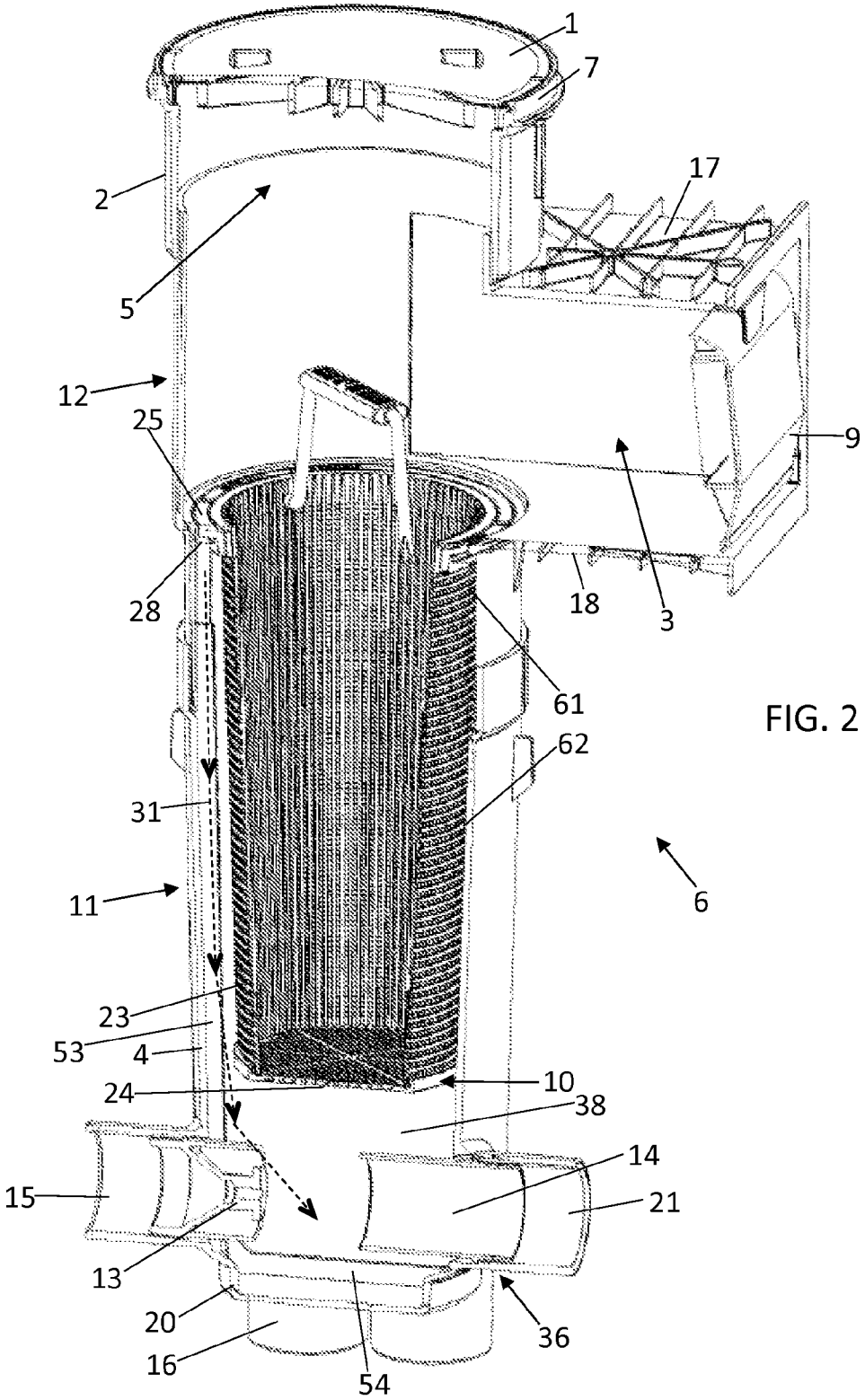
FIG. 2 is a cross sectional view taken along sectional line A-A in FIG. 1 with a first embodiment of a basket mounted therein.
Figure 4:
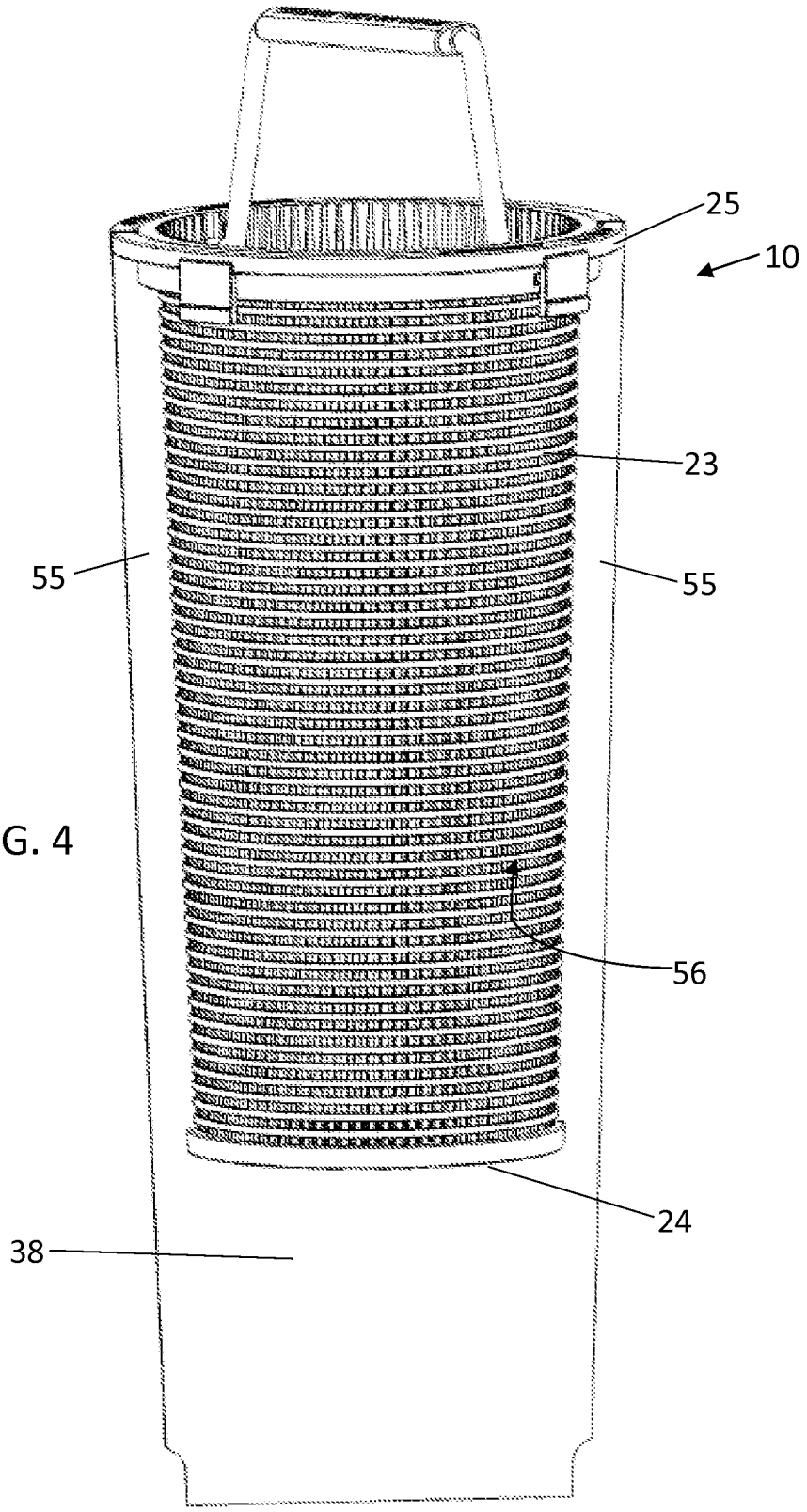
FIG. 4 is a side view of a first embodiment of a basket.

Also contemplated as part of this disclosure is a basket 10 for use with a pool skimmer system 6. FIGS. 2-3 depict cross sectional views of a non-limiting embodiment of a basket 10 mounted within the skimmer housing of a pool skimmer system 6, and FIG. 4 depicts a non-limiting embodiment of a basket 10 separated from the skimmer housing. Similar to conventional baskets, the basket typically comprises an open top end, a porous basket bottom 24, and one or more porous walls 23 extending between the open top end and the porous basket bottom 24.

Advantageous to conventional baskets, however, one or more baskets 10 according to this disclosure comprise a seal plate 38. The seal plate 38 typically extends from basket bottom 24 away from the open top end of the basket 10. When mounted within the skimmer housing, the seal plate 38 typically extends from the basket bottom 24 to the housing bottom 20. According to some aspects, the seal plate 38 extends at least 0.5 inches, at least 1 inch, at least 1.5 inches, at least 2 inches, at least 2.5 inches, at least 3 inches, 3.5 inches or at least 4 inches from the basket bottom 24. Generally, the seal plate 38 extends a sufficient distance to create a chamber 39 to carry the require flow between the bottom 24 of the basket 10 and the bottom 20 of the lower skimmer housing 11, as well as a sufficient distance to cleary the venturi system 36 on the sidewall of the lower skimmer housing 11. When mounted within the skimmer housing, the seal plate 38 also typically extends across an entire diameter 63 of the basket bottom 20 (shown in FIG. 3). The seal plate 38 of one or more embodiments is sized to fit within the sets of side tracks 53 and/or the bottom tracks 54.

According to some aspects, a pool basket may further comprise two opposing seal arms 55 on an outer surface 56 of the basket 10 that extend from the basket bottom 24 partially or entirely to the basket rim 25. The two opposing seal arms 55 are typically planar or continuous with the seal plate 38. More particularly, each seal arm 55 may be configured to span between the outer surface 56 of the basket 10 and the interior skimmer wall 4. In some embodiments, the seal arms 55 slidably engage with the side tracks 53 on the skimmer interior wall 4.

As depicted in the non-limiting embodiment of FIG. 3, when a basket 10 is positioned within the skimmer housing, the seal plate 38 divides the first portion 51 of the housing bottom 20 from the second portion 52. In so doing, the seal plate 38 isolates or separates a suction chamber 39 adjacent the one or more suction ports 16 from the venturi system 36. The suction chamber 39 is typically formed in the second portion 52 of the housing bottom 20 between the seal plate 38 and a portion of the skimmer interior wall 4, and typically between the housing bottom 20 and the porous basket bottom 24. By separating the venturi system 36 from the suction chamber 39, even if the entire interior surface of the basket 10 becomes blocked by debris, the suction from the suction port 16 will not communicate to Venturi return 21. In the specific non-limiting embodiment depicted in FIG. 3, a lower housing 11 is internally adapted with seal channels 40 to receive in a substantially sealing relationship the seal plate 38 of the basket 10. In this way suction from suction ports 16 is isolated from venturi system 36 even if debris have fully closed or blocked the interior of the basket 10.

In one or more embodiments, the skimmer interior wall 4 of the skimmer housing is spaced away from the porous wall 23 of the basket 10 to form an interior fluid path 31 to at least one of the Venturi sleeve 14 or the pump suction port 16. Water flow typically enters the skimmer throat 3 over a weir 9 and continues into the basket 10, then flows to one or more suction ports as previously described. It will be understood by those skilled in the art that leaves and other debris being drawn into the skimmer throat 3 are trapped in the basket 10 and generally drawn to an inner basket surface.

Figure 5:
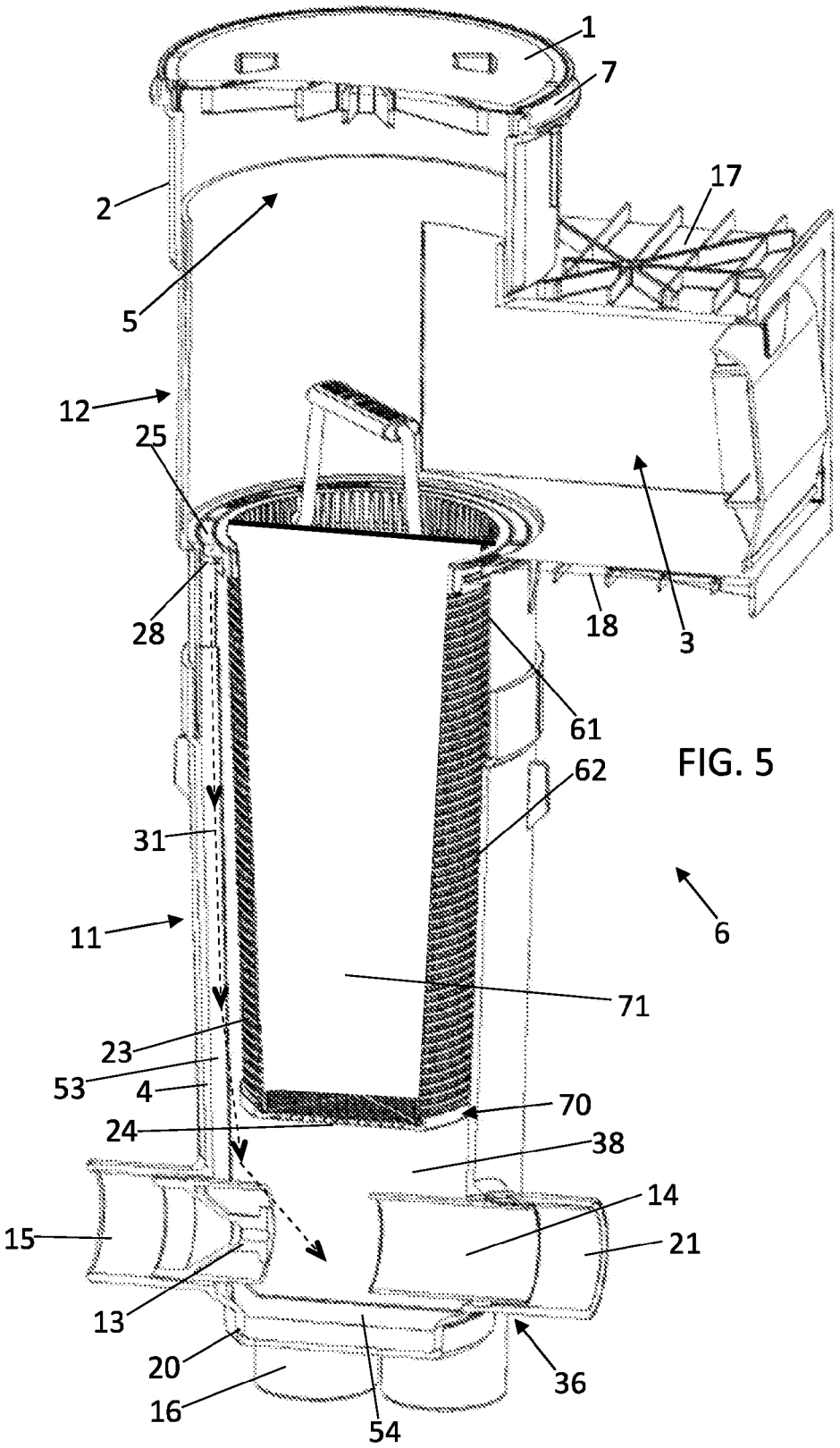
FIG. 5 is a cross sectional view taken along sectional line A-A in FIG. 1 with a second embodiment of a basket mounted therein.

FIG. 5 depicts another non-limiting embodiment of a basket 70 mounted within a skimmer housing. Similar to the basket 10, the basket 70 comprises an open top end, a porous basket bottom 24, one or more porous walls 23 extending between the open top end and the porous basket bottom 24, a basket rim 25, a seal plate 38, and two seal arms 55. Some embodiments of a basket 70 further comprise a basket divider 71 positioned within the basket 70. The basket divider 71 is typically substantially planar and aligned with the seal plate 38 and the seal arms 55. More particularly, the basket divider 71 may extend vertically and along the vertical center of the basket 70 as a continuation of the seal plate 38 across the diameter and for the entire length down the center of the basket 70. In other embodiments, the basket divider extends only partially from the porous basket bottom 24 towards the open top end of the basket 70. The basket divider 71 essentially creates two baskets with a center divide between them, thus further isolating the pump suction ports 16 from the venturi system 36.

It is evident that particular embodiments of pool skimmer systems disclosed herein overcome particular disadvantages of conventional skimmers by eliminating external tubing and allowing for easier maintenance. It is also apparent that if the basket is not installed, pump suction port 16 remains open to the skimmer interior, which in turn is open to atmosphere there by preventing dangerous pump suction at pool return port 21. Moreover, the upper skimmer housing 12 and the lower skimmer housing 11 may also be adapted to fit only a basket 10 described herein to prevent unapproved baskets from being used. The basket rim 25 may also be adapted to form a handle for improved ease of removal of the basket 10 for periodic cleaning without submerging hands in water as with prior art devices.

It will be understood that implementations are not limited to the specific components disclosed herein, as virtually any components consistent with the intended operation of a method and/or system implementation for a pool skimmer system may be utilized. Accordingly, for example, although particular housings, baskets, ports, pumps, and the like may be disclosed, such components may comprise any shape, size, style, type, model, version, class, grade, measurement, concentration, material, weight, quantity, and/or the like consistent with the intended operation of a method and/or system implementation for a pool skimmer system may be used.

In places where the description above refers to particular implementations of a pool skimmer system, it should be readily apparent that a number of modifications may be made without departing from the spirit thereof and that these implementations may be applied to other pool skimmer systems. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A pool skimmer, comprising:

a skimmer housing comprising an upper housing, a lower housing, and a skimmer rim positioned within the skimmer housing, the upper housing comprising a deck throat opening and a pool throat opening and the lower housing comprising a pump inlet port and a pool return port positioned at a first portion of a housing bottom of the lower housing and one or more pump suction ports positioned at a second portion of the housing bottom of the lower housing; and a basket positioned within the housing and comprising a basket rim engaged with the skimmer rim, one or more porous walls, and a seal plate extending from a basket bottom to the housing bottom, the seal plate positioned between the first portion of the housing bottom and the second portion of the housing bottom to form a suction chamber that is adjacent the one or more pump suction ports and isolated from the pump inlet port and the pool return port.

2. The pool skimmer of claim 1, wherein the seal plate extends across a diameter of the basket bottom and further comprises two opposing seal arms that extend from the basket bottom towards the basket rim on an outer surface of the basket.

3. The pool skimmer of claim 2, wherein the two seal arms extend from the basket bottom to the basket rim.

4. The pool skimmer of claim 3, wherein the basket further comprises a basket divider positioned within the basket and aligned with the seal plate and the two seal arms.

5. The pool skimmer of claim 1, wherein the housing further comprises two sets of tracks proximate the housing bottom and positioned between the first portion of the housing bottom and the second portion of the housing bottom and wherein the seal plate is slidably engaged with the two sets of tracks.

6. The pool skimmer of claim 1, wherein the pool skimmer further comprises a venturi nozzle coupled to the pump inlet port and a venturi sleeve coupled to the pool return port, and wherein the one or more pump suction ports comprises two pump suction ports positioned adjacent a second portion of the housing bottom.

7. The pool skimmer of claim 1, further comprising a fluid path between the one or more porous walls of the basket and the housing.

8. The pool skimmer of claim 1, wherein the seal plate extends at least one inch from the basket bottom.

9. A pool skimmer system, comprising:

a skimmer housing comprising an upper housing, a lower housing, and a skimmer rim, the upper housing comprising a deck throat opening and a pool throat opening and the lower housing comprising a pump inlet port and a pool return port positioned at a first portion of a housing bottom of the lower housing and one or more pump suction ports positioned at a second portion of the housing bottom of the lower housing; and a basket sized to removably mount within the skimmer housing and comprising a basket rim configured to engage with the skimmer rim when the basket is mounted within the skimmer housing, one or more porous walls, and a seal plate extending from a basket bottom and sized to interface with the basket bottom when the basket rim is engaged with the skimmer rim such that the seal plate is positioned between the first portion of the housing bottom and the second portion of the housing bottom to form a suction chamber that is adjacent the one or more pump suction ports and isolated from the pump inlet port and the pool return port between the basket bottom and the housing bottom by the seal plate when the basket is mounted within the skimmer housing and the skimmer rim is engaged with the basket rim.

10. The pool skimmer of claim 9, wherein the seal plate further comprises two opposing seal arms that extend from the basket bottom towards the basket rim on an outer surface of the basket.

11. The pool skimmer of claim 10, wherein the two seal arms extend from the basket bottom to the basket rim.

12. The pool skimmer of claim 11, wherein the basket further comprises a basket divider positioned within the basket and aligned with the seal plate and the two seal arms.

13. The pool skimmer of claim 9, wherein the housing further comprises two sets of tracks proximate the housing bottom and positioned between the first portion of the housing bottom and the second portion of the housing bottom and wherein the seal plate is configured to slidably engage with the two sets of tracks.

14. The pool skimmer of claim 9, wherein the pool skimmer further comprises a venturi nozzle coupled to the pump inlet port and a venturi sleeve coupled to the pool return port, and wherein the one or more pump suction ports comprises two pump suction ports positioned adjacent to a second portion of the housing bottom.

15. The pool skimmer of claim 9, wherein the seal plate extends at least one inch from the basket bottom.

16. A pool skimmer basket, comprising:

one or more porous sidewalls;

a basket rim;

a porous basket bottom opposite the basket rim;

a seal plate extending at least one inch from the porous basket bottom, the seal plate configured to isolate a first portion of a skimmer housing bottom from a second portion of a skimmer housing bottom when the pool skimmer basket is mounted within a pool skimmer housing.

17. The pool skimmer basket of claim 16, further comprising two opposing seal arms that extend from the basket bottom towards the basket rim on an outer surface of the basket.

18. The pool skimmer basket of claim 17, wherein the two seal arms extend from the basket bottom to the basket rim.

19. The pool skimmer basket of claim 18, further comprising a basket divider positioned within the basket and aligned with the seal plate and the two seal arms.

20. The pool skimmer basket of claim 19, wherein the seal plate extends at least 2 inches from the porous basket bottom.

* * * * *